US007442060B2

(12) United States Patent
Suwalski et al.

(10) Patent No.: US 7,442,060 B2
(45) Date of Patent: Oct. 28, 2008

(54) ADAPTER AND APPARATUS FOR COUPLING A CORD OF A PERIPHERAL DEVICE WITH A PORTABLE TERMINAL

(75) Inventors: Henry J. Suwalski, Cranberry Township, PA (US); Andres Viduya, Cranberry Township, PA (US)

(73) Assignee: Vocollect, Inc., Pittsburgh, PA (US)

( * ) Notice: Subject to any disclaimer, the term of this patent is extended or adjusted under 35 U.S.C. 154(b) by 0 days.

(21) Appl. No.: 11/461,558

(22) Filed: Aug. 1, 2006

(65) Prior Publication Data

US 2008/0032533 A1 Feb. 7, 2008

(51) Int. Cl.
*H01R 13/62* (2006.01)

(52) U.S. Cl. ..... 439/180; 439/350

(58) Field of Classification Search ..... 439/638, 439/350

See application file for complete search history.

(56) References Cited

U.S. PATENT DOCUMENTS

| | | | | |
|---|---|---|---|---|
| 1,753,317 | A | | 4/1930 | Rothen |
| 2,170,287 | A | | 8/1939 | Kinnebrew |
| 2,369,860 | A | | 2/1945 | Schroeder |
| 3,363,214 | A | | 1/1968 | Wright |
| 3,781,039 | A | | 12/1973 | Locke et al. |
| 3,786,397 | A | * | 1/1974 | Bridges ..... 439/277 |
| 3,808,577 | A | | 4/1974 | Mathauser |
| 3,964,771 | A | * | 6/1976 | Baudouin ..... 285/315 |
| 4,068,913 | A | | 1/1978 | Stanger et al. |
| 4,558,864 | A | * | 12/1985 | Medwedeff ..... 273/148 B |
| D285,439 | S | | 9/1986 | Nagele |
| 4,619,491 | A | | 10/1986 | Drogo |
| 4,620,760 | A | | 11/1986 | Duncan |
| 4,649,332 | A | | 3/1987 | Bell |
| 4,698,717 | A | | 10/1987 | Scheid |
| 4,846,714 | A | | 7/1989 | Welsby et al. |
| 4,874,316 | A | | 10/1989 | Kamon et al. |
| D310,367 | S | | 9/1990 | Dockery |
| 5,024,604 | A | | 6/1991 | Savin et al. |
| 5,052,943 | A | | 10/1991 | Davis |
| 5,187,645 | A | | 2/1993 | Spalding et al. |
| D336,417 | S | | 6/1993 | Yuen et al. |
| 5,371,679 | A | | 12/1994 | Abe et al. |
| 5,393,239 | A | | 2/1995 | Ursich |
| 5,399,102 | A | | 3/1995 | Devine |

(Continued)

OTHER PUBLICATIONS

Vocollect, Wearable Computers Talkman T2x Wearable Computer, product brochure, Sep. 2005 (4 pages).

(Continued)

*Primary Examiner*—Tho D. Ta
*Assistant Examiner*—Travis Chambers
(74) *Attorney, Agent, or Firm*—Wood, Herron & Evans LLP

(57) ABSTRACT

An adapter and apparatus for coupling a corded peripheral device with a portable terminal. The adapter may be used to convert the portable terminal to include an electrical connector having a break-away capability for connecting a corded peripheral device with the terminal. The connector is adapted to disconnect from the portable terminal when a sufficient force is applied to the cord, which disengages the peripheral device from the portable terminal. The ability of the cord to break-away from the portable terminal prevents damage not only to the connector, but also to the cord, peripheral, and terminal.

40 Claims, 12 Drawing Sheets

U.S. PATENT DOCUMENTS

| | | | | |
|---|---|---|---|---|
| 5,456,611 | A | 10/1995 | Henry et al. | |
| 5,462,452 | A | 10/1995 | Devine | |
| 5,478,252 | A | 12/1995 | Lecomte et al. | |
| 5,480,313 | A | 1/1996 | d'Alayer de Costemore d'Arc | |
| 5,501,571 | A | 3/1996 | Van Durrett et al. | |
| 5,517,683 | A | 5/1996 | Collett et al. | |
| 5,639,256 | A | 6/1997 | Endo et al. | |
| 5,657,459 | A | 8/1997 | Yanagisawa et al. | |
| 5,665,485 | A | 9/1997 | Kuwayama et al. | |
| D391,937 | S | 3/1998 | Rosen | |
| 5,803,750 | A | 9/1998 | Purington et al. | |
| D411,171 | S | 6/1999 | Tai Muan | |
| 5,934,911 | A | 8/1999 | Stout et al. | |
| 5,941,726 | A | 8/1999 | Koegel et al. | |
| 5,941,729 | A | 8/1999 | Sri-Jayantha | |
| 5,984,709 | A | 11/1999 | Zink et al. | |
| 5,993,246 | A | 11/1999 | Moldenhauer et al. | |
| D420,325 | S | 2/2000 | Sloey | |
| 6,022,237 | A | 2/2000 | Esh | |
| 6,062,891 | A | 5/2000 | Villiers | |
| 6,149,451 | A | 11/2000 | Weber | |
| 6,213,808 | B1 * | 4/2001 | Whatmore et al. | 439/417 |
| 6,226,622 | B1 | 5/2001 | Dabbiere | |
| 6,237,051 | B1 | 5/2001 | Collins | |
| 6,290,529 | B1 | 9/2001 | Tsurumaru et al. | |
| 6,304,436 | B1 | 10/2001 | Branch et al. | |
| 6,310,888 | B1 | 10/2001 | Hamlin | |
| 6,339,764 | B1 | 1/2002 | Livesay et al. | |
| 6,364,675 | B1 | 4/2002 | Brauer et al. | |
| 6,366,450 | B1 | 4/2002 | Janicek | |
| D460,761 | S | 7/2002 | Croley | |
| 6,454,608 | B1 * | 9/2002 | Kitahara et al. | 439/638 |
| 6,483,698 | B1 | 11/2002 | Loh | |
| D474,736 | S | 5/2003 | Sagawa | |
| D476,359 | S | 6/2003 | Mittler | |
| D477,604 | S | 7/2003 | Lin | |
| 6,597,577 | B1 | 7/2003 | Tang et al. | |
| D491,186 | S | 6/2004 | Arakaki et al. | |
| 6,786,743 | B2 * | 9/2004 | Huang | 439/131 |
| 6,910,911 | B2 * | 6/2005 | Mellott et al. | 439/358 |
| 6,910,922 | B2 | 6/2005 | Haga | |
| D507,794 | S | 7/2005 | Wang et al. | |
| 2004/0002243 | A1 * | 1/2004 | Mellott et al. | 439/180 |

OTHER PUBLICATIONS

Photographs of Vocollect Talkman T2x Wearable Computer (circa 2002) (2 pages).

Lee, Susan Moon, U.S. Patent and Trademark Office, Notice of Allowance Dated Jun. 4, 2007 in related Application No. 29/253,074, 6 pages.

* cited by examiner

ADAPTER AND APPARATUS FOR COUPLING A CORD OF A PERIPHERAL DEVICE WITH A PORTABLE TERMINAL

FIELD OF THE INVENTION

This invention relates generally to portable terminals and more specifically, to adapters and methods for electrically and physically coupling portable terminals with peripherals in a wireless communication system.

BACKGROUND OF THE INVENTION

Wearable, portable and/or mobile terminals are used for a wide variety of tasks. Such terminals allow a worker using them to have mobility, while providing the worker with desirable computing and data-processing functions. Furthermore, various terminals provide a communication link to a larger, more centralized computer system. Such terminals are being implemented for an ever-increasing number of tasks.

One illustrative example of a specific task in which a wearable or portable terminal is used is inventory management. Computerized inventory management systems are used in inventory-driven industries for various tasks, such as food and retail product distribution, manufacturing, and quality control. An overall integrated inventory management system involves a combination of a central computer system for tracking and management, and the people who use and interface with the computer system in the form of order fillers, pickers and other workers. The workers handle the manual aspects of the integrated management system.

To provide an interface between the central computer system and the workers, wearable or portable computers or terminals are used by the workers as they complete their numerous tasks. Such portable terminals, for example, pull information directly from the central system and translate the information into voice or text commands for the workers. Through wireless radio frequency (RF) networks, the commands to and responses from the workers are communicated between the system and the terminals. To communicate in a voice-driven system, for example, the worker wears a headset, which is coupled to their portable terminal. Through the headset, the workers are able to receive voice instructions, ask questions, report the progress of their tasks, and report working conditions, such as inventory shortages, for example. Using such terminals, the work is done virtually hands-free without equipment to juggle or paperwork to carry around.

In addition to headsets, other peripherals are often coupled to the terminals depending upon the tasks to be performed. For example, bar code readers and other scanners may be utilized alone or in combination with a headset to communicate back and forth with the system.

An illustrative example of a job through a system utilizing wearable and/or portable terminals having voice capabilities may involve initially welcoming the worker to the system and defining a particular task or order, for example, a load to be filled for a certain truck to depart from a warehouse. The worker may then answer with a particular area (e.g., freezer) that they will be working in for that order. The system then vocally directs the worker to a particular aisle and bin to pick a particular quantity of an item. The worker then vocally confirms their location and the amount of items that are picked. The system may then direct them to a loading dock or bay for a particular truck to receive the order. As may be appreciated, various different scenarios might be played out through the system using a portable terminal and attached peripherals.

The peripherals, such as a headset, are attached to a terminal with a cord, which extends generally from the terminal (typically worn on a belt) to the head of the worker where the headset is located. As may be appreciated, the workers are moving rapidly around their work area and are often jumping on and off forklifts, pallet loaders, and other equipment. Therefore, there is a possibility for a cord to get caught on some object, such as a forklift. When this occurs, the cord will tend to want to separate either from the headset or from the terminal. Generally, the cords are permanently attached to a headset and each worker maintains their own headset (e.g. for individual responsibility and/or hygiene purposes). The cords are then plugged into the terminals, therefore the separation will generally occur at the terminal socket.

Attempts have been made to appropriately handle a snagged cord and cord separation. However, there are competing issues that must be addressed. When the cord plug is strongly secured to the terminal socket, a snagged cord may pull the socket out of the terminal housing. This may render the terminal inoperable and require repair or replacement. However, strengthening the anchoring point of the socket in the terminal may lead to cords pulling away from their plug, thus rendering the headset unusable. Making the cord more securely attached with its plug, making the terminal socket securely anchored in the terminal housing, and then providing a secure coupling between the plug and the socket, however, may prevent separation but may leave the cord susceptible to catching on surrounding objects resulting in damage to the cord and/or the plug.

Often, portable terminals will include a jack accessible from the exterior of the terminal that is configured to receive a standard connector terminating the cord of a peripheral, such as a voice/speech headset. The portable terminal includes circuitry that is coupled electrically with the jack for unidirectional or bidirectional communication between the circuitry and the peripheral. The cord of such peripheral devices is susceptible to the same, or similar, problems with catching on surrounding objects and the ensuing damage that may occur to the cord and/or plug if the plug cannot release from the socket.

Therefore, it is desirable to improve upon the conventional portable terminals used in an environment where peripherals and their cords are susceptible to snagging.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Although the invention will be described next in relation to certain embodiments, the invention is not limited to practice in any one specific type of portable or portable terminal. It is contemplated that the principles of the invention can be used with a variety of electronic devices, including but not limited to wearable, portable and/or mobile terminals for use with inventory systems. The description of the invention is intended to cover all alternatives, modifications, and equivalent arrangements as may be included within the spirit and scope of the invention as defined by the appended claims. In particular, those skilled in the art will recognize that the components of the invention described herein could be arranged in multiple different ways.

Figure 1:
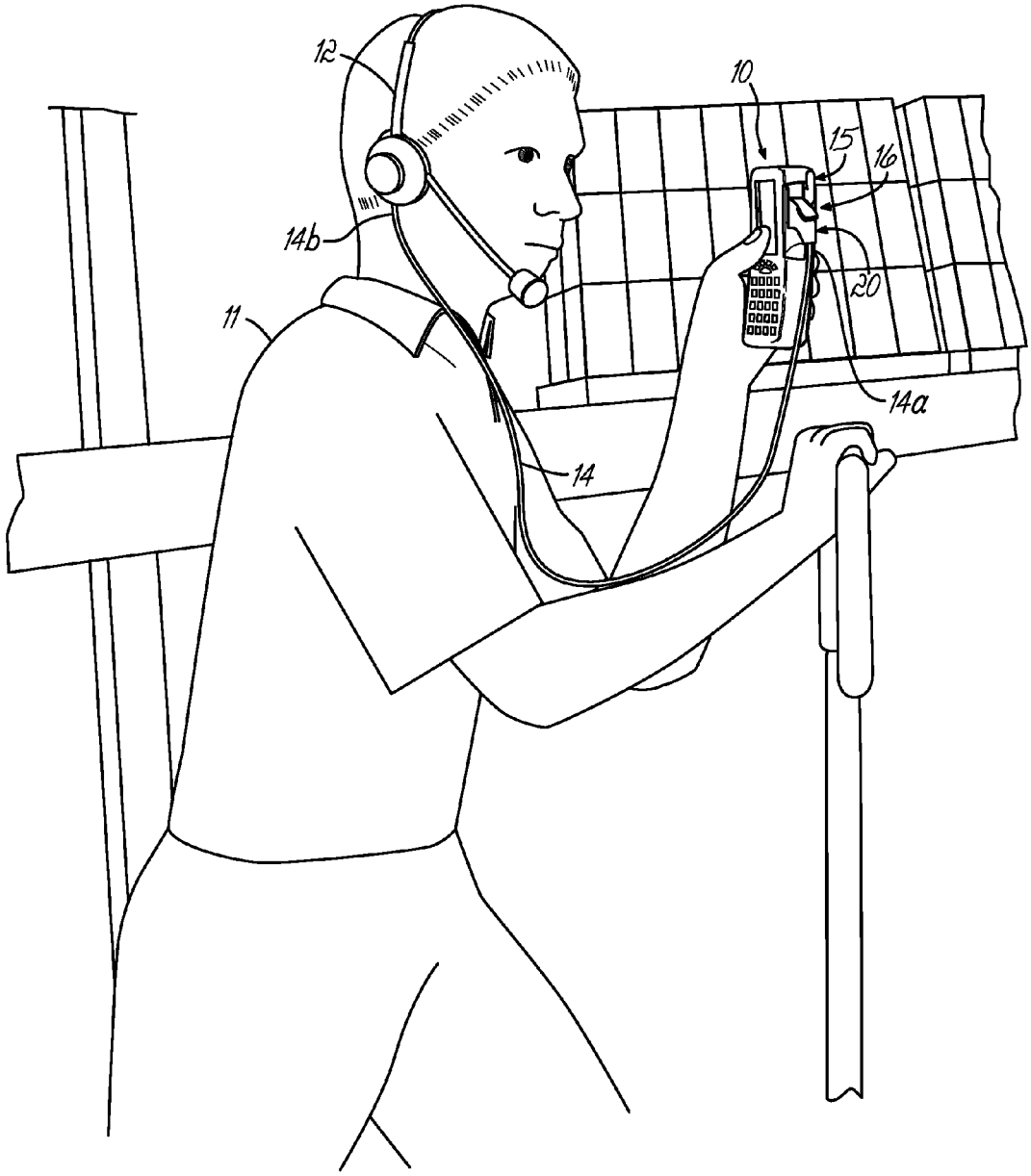
FIG. 1 is an illustration of a portable terminal incorporating an adapter in accordance with the present invention.
Figure 2:
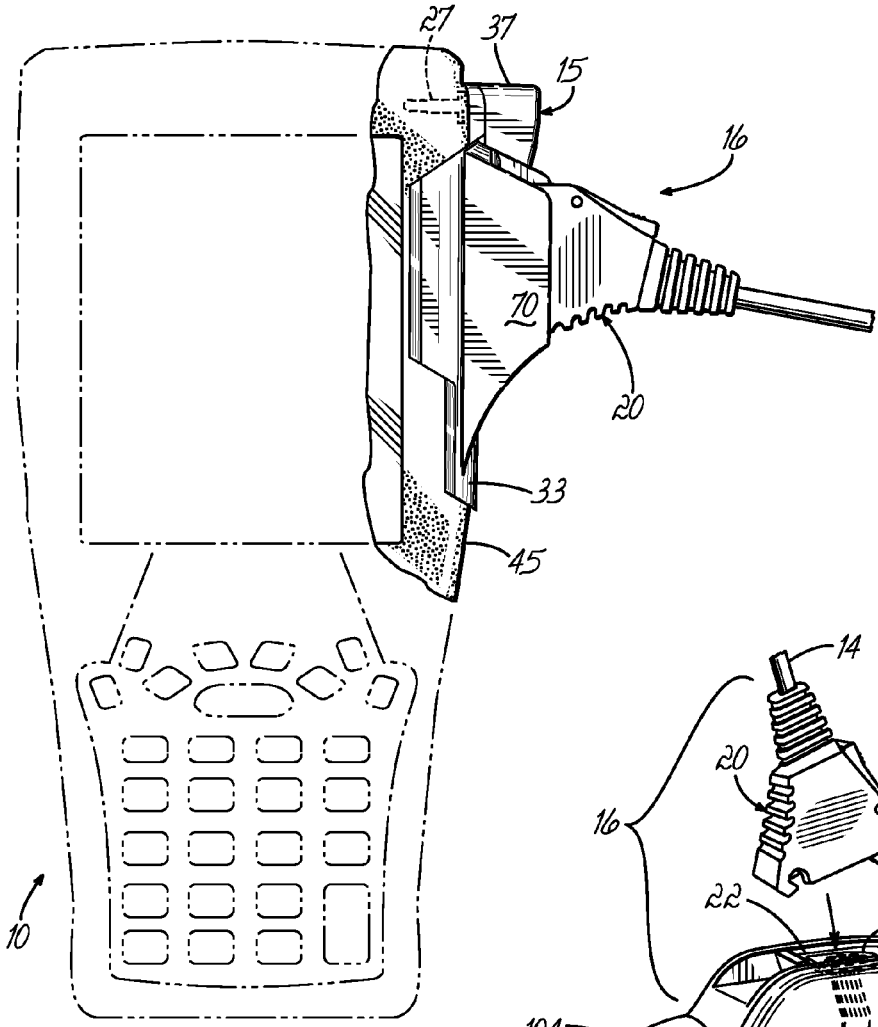
FIG. 2 is a front view of the portable terminal and adapter of FIG. 1.

Referring to FIGS. 1 and 2, a portable terminal 10, which may be carried as a handheld device by a worker 11, is coupled to a peripheral device 12, such as a voice headset, by a cord 14. The portable terminal 10 and peripheral device 12 may permit a worker 11 to communicate bi-directionally with a central computer system, or other information system, to send and receive information regarding the activities performed by the worker 11 and the inventory being managed.

The peripheral device 12 is adapted with a transducer that generates a signal in response to a suitable input, such as voice or speech input, from the worker 11. The cord 14 includes multiple conductors that electrically couple the peripheral device 12 with the portable terminal 10 for transferring the signal from the peripheral device 12 to the portable terminal 10. The central computer system constitutes part of a larger system for sending and receiving information regarding the activities and tasks to be performed by the worker 11. The central computer system may run one or more system software packages for handling a particular task, such as inventory and warehouse management. The peripheral device 12 may also include another transducer that translates information received from the computer system into a format understood aurally by the worker 11 and conveyed to the worker 11 by a speaker or other audio transducer.

Cable or cord 14 is mechanically and electrically coupled to the terminal 10 by a break-away connector 16. The connector 16 includes a plug or plug portion 20 secured to, or placed at, one end 14*a* of the cord 14 and a socket or socket portion 22 integrated into the construction of an adapter 15 for the terminal 10. An opposite end 14*b* of the cord 14 is electrically and physically coupled with the peripheral device 12. In certain environments, for example, environments in which inventories are managed, the cord 14 connecting the peripheral device 12 with the terminal 10 may become snagged or entangled, such as on shelving structures or equipment used to transport the items collected from the inventory. To combat the effects of the snagging or entanglement, it is desirable to have a connector 16 that provides a secure electrical connection between cord 14 and terminal 10, but configured such that plug portion 20 will break away from the socket portion 22 at a specified break-away force. This permits the plug portion 20 of connector 16 to become uncoupled or disconnected from the socket portion 22, which is affixed to the terminal 10, to prevent damage to the terminal 10, peripheral device 12, or cord 14.

With reference to FIGS. 2-9, the portable terminal 10 and the peripheral device 12 are electrically and physically connected by the coupled plug and socket portions 20, 22. The peripheral device 12 and the portable terminal 10 are electrically connected by connections between contacts 32, such as pins, on the plug portion 20 and corresponding contacts 74 on the socket portion 22. The plug and socket portions 20, 22 may be provided with a key 61 and a corresponding keyway or key slot 62, respectively, to ensure that the appropriate plug portion 20 is coupled to a complementary socket portion 22. Connectors having plug and socket portions similar to the plug and socket portions 20, 22 of connector 16 may be found in U.S. Pat. No. 6,910,922, the disclosure of which is hereby incorporated by reference herein in its entirety.

The adapter 15 bearing the socket portion 22 is physically coupled with an outer case 45 of the terminal 10 by a mounting plate 17. The mounting plate 17 is adhesively bonded to the terminal by an adhesive strip 17*a*, which is illustrated as initially applied to a surface on the terminal 10. Alternatively, the adhesive strip 17*a* may be initially bonded with the mounting plate 17, which is then moved to secure the mounting plate 17 with the terminal 10. The mounting plate 17 may be a strip of a material, such as metal or plastic, that is cut, deformed, and machined to provide posts 18*a,b*. The mounting plate 17 includes a plurality of internally threaded posts 18*a,b* that are spaced along the length of the strip.

The adapter 15 includes a socket housing 70 with a plurality of clearance openings 21*a,b* that are brought into aligned registration with the posts 18*a,b*, after the mounting plate 17 is adhesively bonded to the terminal 10, and secured by conventional fasteners 23*a,b* to the mounting plate 17. Alternatively, the mounting plate 17 may be omitted if the terminal 10 already includes an existing set of threaded openings (not shown) appropriate for fastening the adapter 15 to the terminal 10 with fasteners 23*a,b*.

The mounting plate 17 may be secured or attached to the case 45 of the terminal 10 in different manners. For example, adhesively-backed halves of a hook-and-loop fastening element, such as a VELCRO® brand fastener or a 3M™ Dual Lock™ reclosable fastener, may be mounted to the mounting plate 17 and case 45 and mated together to provide the attachment. Other methods of attaching the mounting plate 17 to case 45 include, but are not limited to, a snap fit attachment, or one or more Christmas tree push-in fastener or connector common in the automotive industry. Alternatively, the mounting plate 17 may be eliminated entirely and the adapter 15 may be permanently bonded with the case 45 of portable terminal 10 using an adhesive.

Advantageously, the mounting plate 17 attaches the adapter 15 to terminal 10 so that the adapter 15 is married with the terminal 10 without penetrating the outer case 45 of the terminal 10 or providing a new access path through the outer case 45 into the interior of the terminal 10. Instead, the present invention advantageously relies on a pre-existing access path for the transfer of electrical signals through the outer case 45 and to the circuitry housed inside the terminal 10 afforded by a cooperating, existing electrical connector element represented by jack 29. The mounting plate 17 is mounted to the outer case 45 of terminal 10 in a manner and at a location that does not occlude the entrance to the jack 29.

The adapter 15 includes an electrical connector element 27 having a tip 27*a* that is inserted into the jack 29 and a bundle of individual conductors 25 that electrically couple the electrical contacts 74 on a mating surface 75 of the socket portion 22 with the electrical connector element 27. The mating surface 75 is carried on a face of an electrical terminal 72 that is installed in an opening 69 in the adapter 15. The conductors 25 are placed in a race or channel 13 defined in the socket housing 70. The tip 27*a* of electrical connector element 27 projects outwardly beyond the side of the adapter 15 facing the terminal 10 so that, when the adapter 15 is mounted to the terminal 10, the electrical connector element 27 can be readily engaged with the jack 29. When the tip 27*a* of the electrical connector element 27 is inserted into the jack 29, the electrical contacts 74 are electrically coupled by the conductors 25 and the mated electrical connector element 27 and jack 29 with circuitry (not shown) inside the terminal 10. The circuitry of the terminal 10 may provide voice or speech capabilities that supports the operation of the peripheral device 12. Additional circuitry (not shown), such as electronic components for electrical isolation or gain adjustment, may be incorporated into the conductive paths of conductors 25.

Although the invention is not so limited, the electrical connector element 27 is illustrated as a standard audio connector used conventionally to provide connections with a headset having a microphone and either mono or stereo earphones. Such audio connectors generally are commercially available in two standard sizes, 2.5 mm and 3.5 mm diameter. Alternatively, the electrical connector element 27 may be a conventional D-subminiature connector, such as a serial RS-232 connector, intended to provide connection to a variety of peripheral devices. Such D-subminiature connectors generally are commercially available in four standard sizes that are based on the number of contacts, e.g., 9-pin, 15-pin, 25-pin, and 37-pin. Alternatively, the electrical connector element 27 may be a conventional high-density connector commonly used for expansion ports on devices such as notebook computers, industrial terminals, and office automation equipment and which are available in a variety of sizes and configurations. Alternatively, the electrical connector element 27 may be a standard Universal Serial Bus (USB) Mini-B connector or a standard IEEE-1394 "Firewire" connector. Electrical connector element 27 may have any suitable construction understood by a person having ordinary skill in the art.

After loosening and removing the fasteners 23*a,b*, the adapter 15 is easily removable from the portable terminal 10. In this manner, the jack 29 can be readily returned to its original state. In its original state, the plug of a conventional headset (not shown) may be electrically coupled with the jack 29. It may also be advantageous to have the ability to remove the adapter 15 for purposes of servicing the portable terminal 10 to perform repairs or maintenance. For example, the case 45 may have a seam along which portions of the case 45 are separated and adapter 15 may hinder separation if not removed.

The adapter 15 replaces a conventional connector (not shown) with a sturdier and more reliable connection point for peripheral device 12. With cumulative insertions into jack 29 and removals from jack 29, conventional connectors are susceptible to failure after typically a few connection/disconnection cycles. If the terminal 10 participates only a portion of the working day, for example, in a voice application, conventional connectors are connecting and disconnecting multiple times each day to eliminate the tethering of the peripheral device 12. One failure mode is the creation of static in the peripheral device 12, which may render the peripheral device 12 unusable and necessitate repair.

Substituting the adapter 15 for a conventional connector also stabilizes the connection of the peripheral device 12 to the terminal 10. The electrical connector element 27 of adapter 15 experiences significantly less movement than a conventional connector (not shown) plugged into jack 29. Such conventional connectors may develop static arising from movement and rotation during use.

The circuitry inside the portable terminal 10 may be configured for operation with the peripheral device 12 or may be configurable by a software or firmware update for compatibility with the operation of the peripheral device 12. For example, the portable terminal 10 may support voice/speech capabilities that rely on the jack 29 for input/output of communications between the circuitry and the peripheral device 12. After the terminal 10 is modified with the adapter 15, the adapter 15 of the present invention adds a break-away capability to the jack 29 previously unavailable with conventional connectors (not shown).

The housing 70 of the adapter 15 includes a first region 26 that carries the socket portion 22 and a second region 31 that contacts the mounting plate 17 and/or terminal 10 when the adapter 15 is coupled with the terminal 10. The second region 31 includes skirts 33, 35 that wrap about opposite side edges of the terminal 10 and partially overlap portions of the terminal 10 near the opposite side edges when the adapter 15 is physically coupled with the terminal 10. When the adapter 15 is physically mounted to the terminal 10, the skirts 33, 35 do not obscure any operative feature of the terminal 10, such as a display or keypad, that is necessary for operation of the terminal 10. Skirt 33 is separated from skirt 35 by a distance, W, sufficient to insert a side edge of the outer case 45 of terminal 10 in the space between the skirts 33, 35.

Projecting from the peripheral edge of the housing 70 is a cowling 37 that holds and covers the electrical connector element 27 when viewed from the side of the adapter 15 engaged by the plug portion 20. The cowling 37 is positioned on the adapter 15 and operates to position the electrical connector element 27 such that, when the adapter 15 is physically mounted to the terminal 10, the tip 27*a* of the electrical connector element 27 readily mates with the jack 29. The cowling 37 seamlessly bridges the skirts 33, 35 and includes spring fingers 39*a,b* that cooperate with the interior contour of the cowling 37 to grip the electrical connector element 27.

With continued reference to FIGS. 2-9, the plug portion 20 includes a plug housing 24 coupled with end 14*b* of cord 14. A strain relief section 28 provided at one end of the plug housing 24 helps to retain the multi-conductor cord 14 and participates in preventing damage to individual conductors 30 within the cord 14 which may be caused by tension applied to the cord 14. Individual conductors 30 of the multi-conductor cord 14, which are separated within the plug housing 24, are each electrically coupled at one end with respective electrical contacts 32. The electrical contacts 32 may be retractable contacts, such as pogo pin contacts, although the invention is not so limited. The contacts 32 protrude through apertures 34 provided in a mating surface 36 of an electrical terminal 71 of the plug portion 20. The contacts 32 have respective biasing members or springs 38 that bias the contacts 32 in a direction toward the mating surface 36, and which also permit the contacts 32 to be displaced inwardly such that they are substantially flush with the mating surface 36 when the plug portion 20 is coupled with the terminal portion 10.

Each contact 32 is provided with an insert 42, such as a solder cup, that is press-fit into a corresponding cavity 41 provided in the plug housing 24. Each spring 38 is compressed between the insert 42 and a frustoconical portion 43 of the respective contact 32. The insert 42 also electrically couples each conductor 30 of the multi-conductor cord 14 with a corresponding one of the electrical contacts 32. The insert 42 operates to seal off the junction between each conductor 30 and the corresponding contact 32 from moisture infiltrating about the contact 32 into the associated cavity 41.

When the portable terminal 10 is transferred between warm, humid environments, such as a warehouse or the outdoors, and cold, dry environments, such as a storage freezer, there may be a tendency for the condensation which develops on the connector 16 to freeze, potentially interfering with the electrical contacts 32. Advantageously, the spring force of the springs 38 on contacts 32 may be selected such that the spring force will dislodge any frozen water (i.e., ice) that may have formed over the contacts 32, when the connector portions are uncoupled and the contacts 32 are moved toward their extended positions by springs 38.

The plug portion 20 further includes first and second engagement claws 44, 46 that are used to secure the plug portion 20 to the socket portion 22 in a break-away fashion. The first engagement claw 44 is provided on one part of the plug housing 24 such as by being formed with the housing 24, for example. The second engagement claw 46 is provided on a lever arm 48 that is pivotally mounted by a pin 50 to another part of the plug housing 24, such that the second engagement claw 46 on the lever arm 48 is positioned substantially opposite to the first engagement claw 44 on the housing 24. A biasing member or spring 52, which is disposed between the lever arm 48 and the plug housing 24, biases the arm 48 in one direction toward a first position for engaging the socket portion 22 of connector 16 when coupled thereto. The lever arm 48 may be pivoted in the opposite direction toward a second position for coupling and uncoupling the plug and terminal portions 20, 22 by rotating the lever arm 48 about the pin 50 against the force of spring 52. A protrusion 54 formed into one end of the lever arm 48 helps to retain the spring 52 in position on the plug housing 24 along with a cavity 53 in the housing 24.

Figure 9:
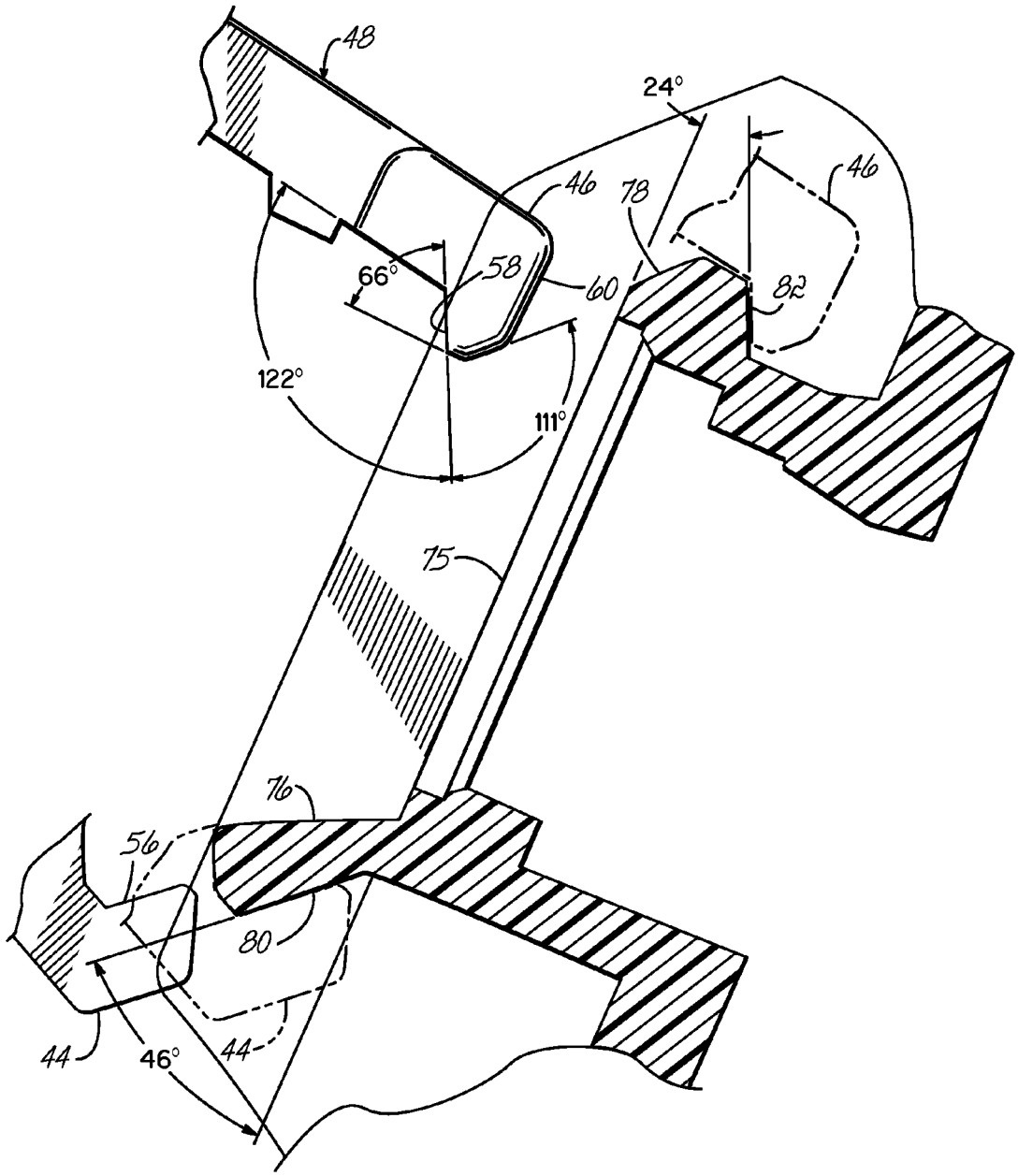
FIG. 9 is a view showing detail of the adapter in cross-section and the lever arm and engagement claws in elevation.

The first and second engagement claws 44, 46 have angled surfaces 56, 58, respectively, which facilitate coupling the plug portion 20 with the socket portion 22. The second engagement claw 46 on lever arm 48 has a leading edge 60 which is angled to facilitate coupling the plug portion 20 with the socket portion 22, whereby contact between leading edge 60 and a second engagement lip 78 urges lever arm 48 from the first position toward the second position, against the opposing bias force created by spring 52. In an exemplary embodiment, leading edge 60 is angled approximately 111° from a surface parallel to the angled surface 58 of second engagement claw 46, as depicted in FIG. 9. The angled surfaces 56, 58 also permit the plug portion 20 to become uncoupled from the socket portion 22 when a specified force is applied to the plug portion 20, as will be described more fully below.

With continued reference to FIGS. 2-9, the plug housing 24 is configured to mate with the socket housing 70 of the socket portion 22. The electrical contacts 74 are configured generally with the same arrangement as the corresponding electrical contacts 32 of the plug portion 20. In the exemplary electrical connector 16, the electrical contacts 74 have flat ends which protrude just above, but generally flush with, mating surface 75 of the socket portion 22 (as opposed to the upraised pins 32) that is configured to interface with the mating surface 36 of the plug portion 20.

Figure 6:
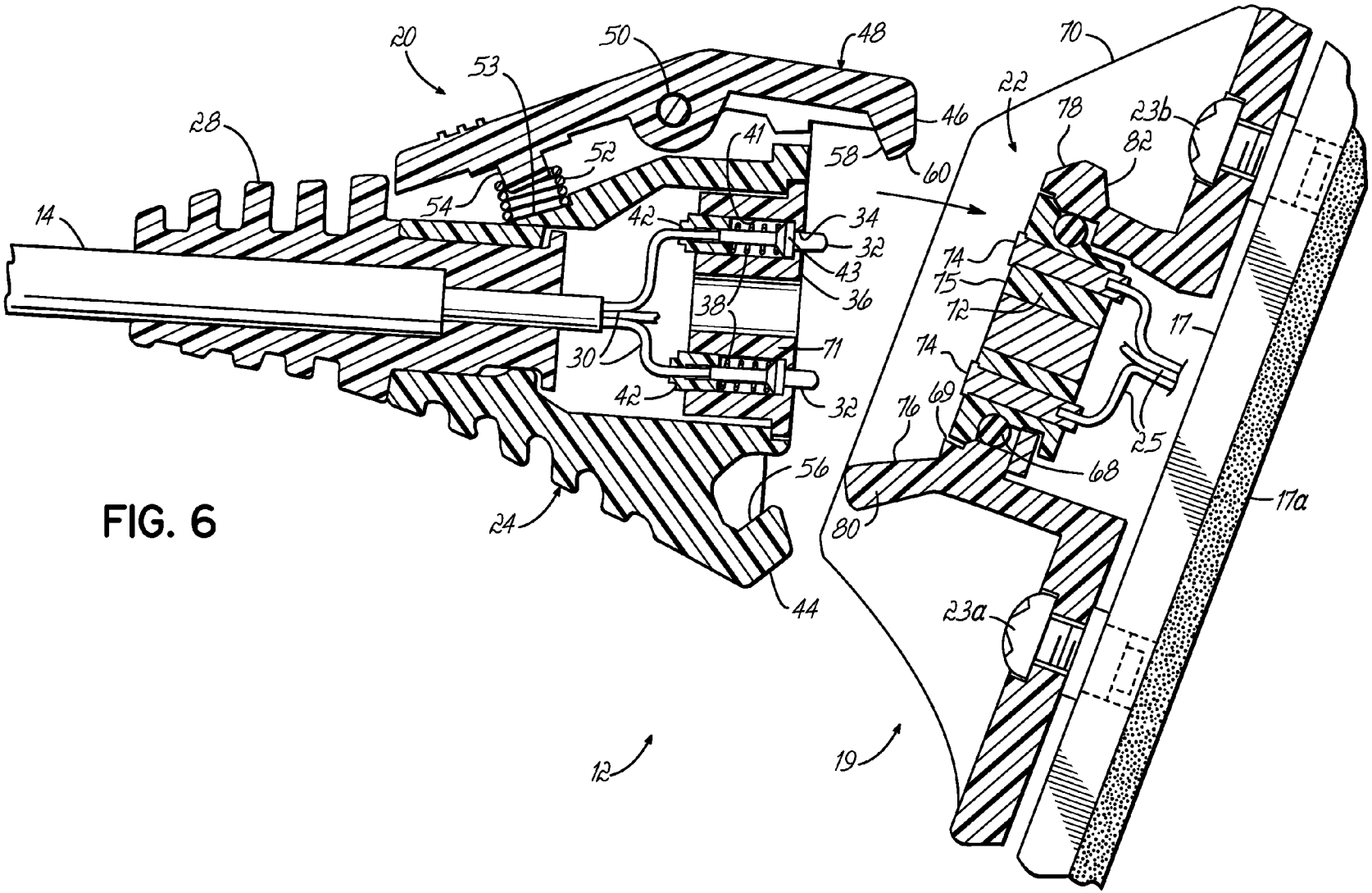
FIG. 6 is a cross-sectional view taken generally along lines 6-6 of FIG. 3.
Figure 7:
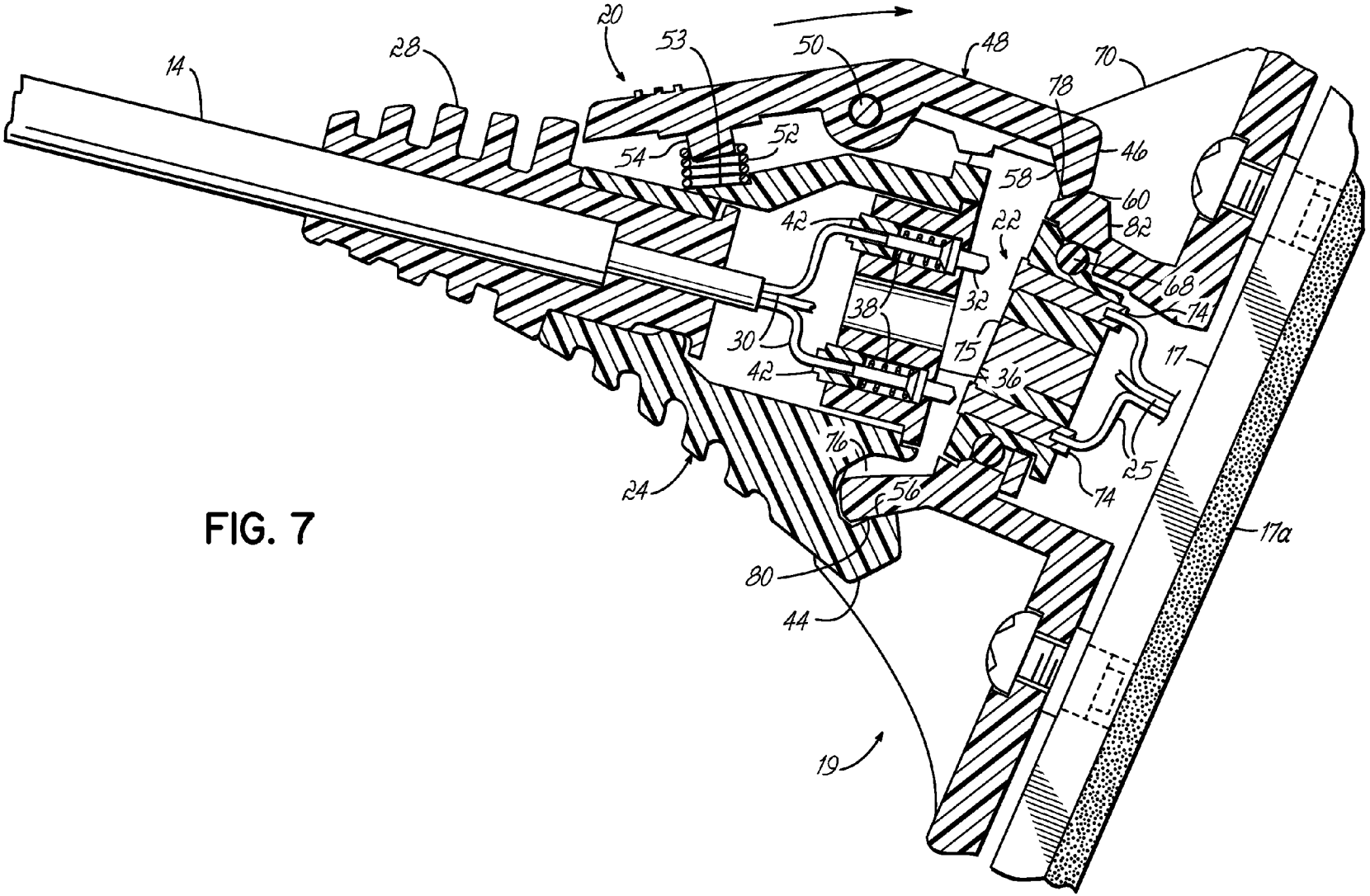
FIG. 7 is a cross-sectional view similar to FIG. 6 showing the plug and terminal portions just prior to coupling.
Figure 8:
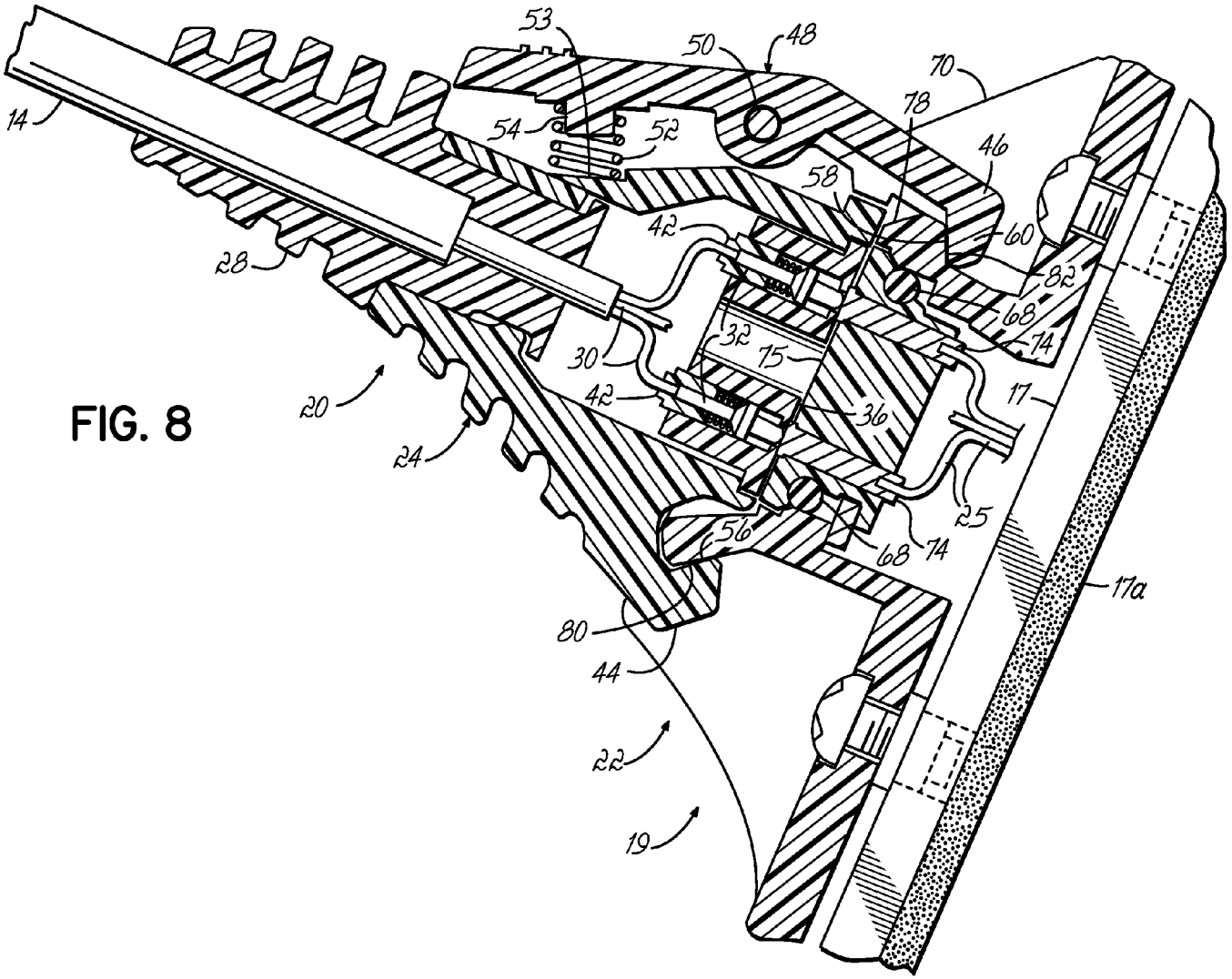
FIG. 8 is a cross-sectional view similar to FIG. 6 depicting the plug and terminal portions coupled together.

As best shown in FIGS. 6-8, the terminal contacts 74 are configured to mate with the contacts 32 of the plug portion 20 when the plug portion 20 is coupled to the socket portion 22. An O-ring 68, which is optional, may be positioned inside the socket housing 70 to protect the conductor-contact interface against moisture infiltration. While the contacts 32, 74 shown in the exemplary embodiment are pogo pins and flat contacts configured to mate with the pogo pins, it will be understood that the contacts 32, 74 may be of various other configurations as are known in the art.

The socket housing 70 includes first and second engagement lips 76, 78 which are configured to mate with the first and second engagement claws 44, 46 of the plug portion 20 when the plug portion 20 is coupled to the socket portion 22. The first and second engagement lips 76, 78 have angled surfaces 80, 82 which correspond to the angled surfaces 56, 58 of the first and second engagement claws 44, 46, respectively, whereby the contact between the first and second engagement claws 44, 46 and first and second engagement lips 76, 78 retains the plug portion 20 on the socket portion 22, as shown in FIG. 8. When the plug portion 20 and the socket portion 22 are coupled together, the mating surfaces 36, 75 of the plug and socket portions 20, 22 interface with one another such that the contacts 32 on the plug portion 20 and the contacts 74 on the socket portion 22 are in full physical and electrical contact. The mating surface 75 is disposed between the first and second engagement lips 76, 78.

Advantageously, the angled surfaces 56, 58, 80, 82 on the first and second engagement claws 44, 46 and on the corresponding first and second engagement lips 76, 78 act in cooperation with the spring 52 on the plug portion 20 to allow the plug portion 20 to break away from the socket portion 22 when force of a specific magnitude is applied to the plug portion 20. This force may be applied to the plug portion 20 through the cord 14 connected to the plug housing 24, such as when the cord 14 becomes snagged on an object or machine. Accordingly, the angled surfaces 56, 58, 80, 82 on the first and second engagement claws 44, 46 and the first and second engagement lips 76, 78 may be selected, in conjunction with a given spring constant of the spring 52 on the plug housing 24 to permit the plug portion 20 to break away from the socket portion 22 at a predetermined break-away force. This break-away force may be applied to the plug portion 20 in any direction, such as normal to the mating surface 36, tangential to the mating surface 36, or generally any angular direction therebetween.

When the force applied to plug portion 20 reaches the predetermined break-away force value, the force causes the lever arm 48 to rotate about pin 50 toward the second position. As the second position is reached or in the second position, plug portion 20 uncouples from socket portion 22. The relationship between the angled surfaces 58, 82 is such that the relative length dimensions of corresponding surfaces 58 and 82 determine the amount of rotation of lever arm 48 about pin 50 against the force created by the accompanying compression of spring 52.

Advantageously, the break-away force may be specified such that the plug connector portion 20 will remain coupled to the socket portion 22 during normal operation of the terminal 10, but permits the plug portion 20 to uncouple from the socket portion 22 when the force applied to the plug portion 20 through the cord 14 reaches the specified break-away force to thereby prevent damage to the electrical connector 16, or to prevent hindering the user of terminal 10. For example, the orientation of the angled surfaces 56, 58, 80, 82 and the spring constant of spring 52 may be selected such that the break-away force is approximately equal to a force at which cord 14 has been rated to operate without sustaining damage, multiplied by a design factor.

Generally, the force for which the cord 14 is rated to operate without sustaining damage is specified by the manufacturer of the cord 14. The design factor generally has a value less than unity (1) and is applied to the rated force to account for variations in material properties, the number of loadings which may be experienced by the cord, the durability of the cord over time, and other considerations which add uncertainty to the determination of a proper rating for the cord. In an exemplary embodiment, cord 14 is rated for about 40 pounds and the design factor is selected to range from about 0.25 to about 0.33, whereby the desired break-away force is about 10 pounds.

With specific reference to FIG. 9 and in an exemplary embodiment of the present invention, the first engagement claw 44 has an angled surface 56 oriented approximately 46° from the mating surface 36 of the plug portion 20 and the second engagement claw 46 has an angled surface 58 oriented approximately 24° from the mating surface 36 of the plug portion 20 when the lever arm 48 is in the first position, as depicted by phantom lines in FIG. 9. In the exemplary embodiment, the 24° angle of the surface 58 of second engagement claw 46 corresponds to an angle of approximately 122° from a surface that is parallel to a longitudinal axis of lever arm 48, as shown in FIG. 9. The socket portion 22 of the exemplary embodiment has first and second engagement lips 76, 78 with angled surfaces 80, 82 oriented at approximately 46° and 24°, respectively, from a plane containing the mating surface 75 of the socket portion 22. When the spring constant of the spring 52 is 81.5 lb/in., the break-away force of the exemplary electrical connector 16 is in the range of approximately 8 to 12 pounds. Of course, other selected break-away force ranges may be used, such as by varying the spring force of spring 52 or the angles of the respective angled surfaces 56, 58, 80, 82 on the engagement claws 44, 46 and lips 76, 78. Generally, the break-away force may range from about 3 pounds to about 15 pounds without departing from the spirit and scope of the invention.

The plug housing 24, socket housing 70, and arm 48 may be formed by molding from polymeric material. In an exemplary embodiment, the plug housing 24, socket housing 70, and arm 48 are formed from XENOY®, a thermoplastic resin available from GE Plastics, Seven Hills, Ohio. This particular polymer has good low temperature characteristics useful when the connector 16 is exposed to low temperatures.

With reference to FIGS. 1-9, the use of the adapter 15 will be described. The adapter 15 is modified to select the specific type of electrical connector element 27 that mates with the jack 29 of terminal 10 and the mounting plate 17 is adhesively bonded with a surface of the terminal 10 at a location that permits the tip 27*a* of the electrical connector element 27 to be coupled with the jack 29. The socket housing 70 is fastened to the mounting plate 17 using the fasteners 23*a,b*. The plug portion 20 and the socket portion 22 are then coupled for physically and electrically coupling the cord 14 of the peripheral device 12 to the portable terminal 10. To that end, the worker 11 depresses lever arm 48 on the plug portion 20 to move the arm 48 toward the second position and brings the first engagement claw 44 on the plug portion 20 into engagement with the first engagement lip 76 on the socket portion 22. The worker then urges the second engagement claw 46 into engagement with second engagement lip 78, whereby the angled leading edge 60 of the second engagement claw 46 facilitates engagement of the claw 46 with second engagement lip 78. Mating surfaces 36, 75 are brought into substantially abutting relation and contacts 32, 74 are in full contact with one another. The plug portion 20 and socket portion 22 are fully coupled and the worker 11 may then release lever arm 48. Advantageously, the connector 16 securely couples the peripheral device 12 to the portable terminal 10 during normal activities of the worker 11. However, if a cord 14 between peripheral device 12 and plug portion 20 should become snagged on an object or machine, the plug portion 20 will uncouple from the socket portion 22 when the force applied to plug portion 20 through cord 14 reaches the specific break-away force to thereby prevent damage to terminal 10, connector 16 or cord 14 while allowing a clean break-away for the worker 11 without manual actuation of the lever arm 48. The connector 16 may then be easily coupled or re-secured with the portable terminal 10 for further use.

The adapter 15 may be used as a portion of a process converting the portable terminal 10 to include voice-direction across a voice user interface, which couples the portable terminal 10 for voice communication with a remote computer system (not shown).

Figure 10:
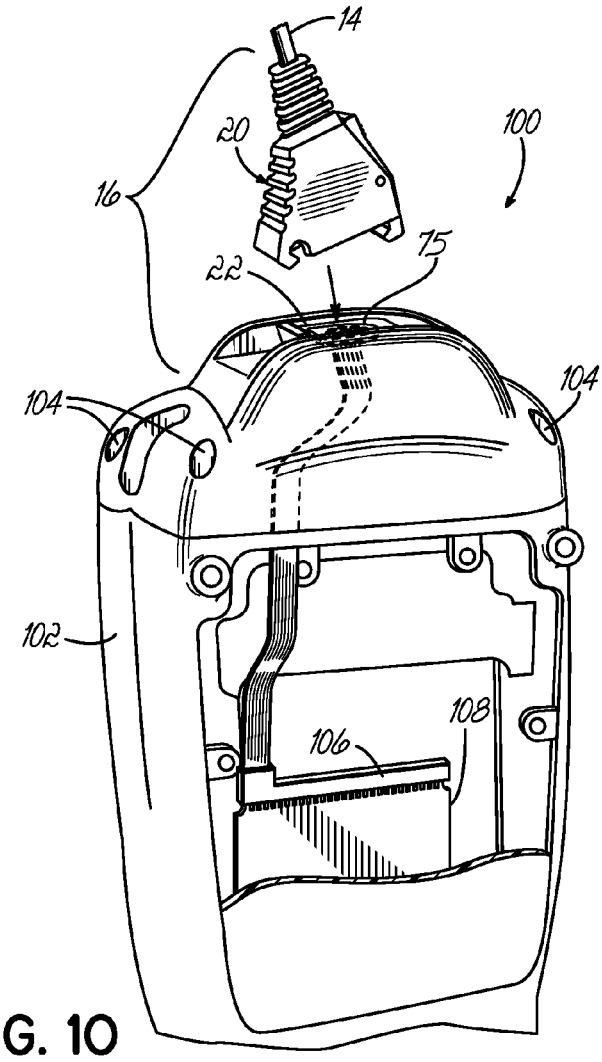
FIG. 10 is a view in partial cross-section of an adapter in accordance with an alternative embodiment of the present invention.
Figure 3:
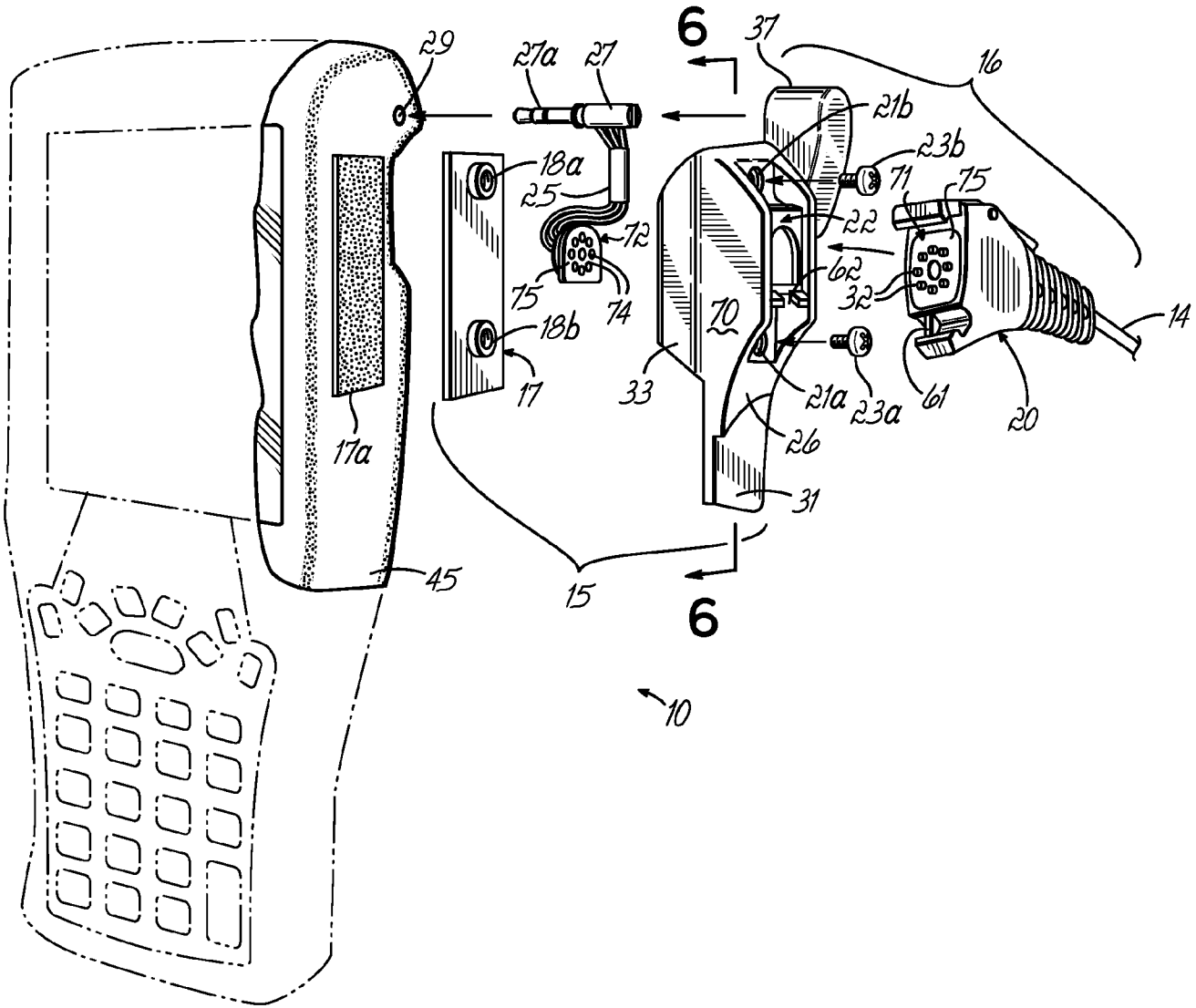
FIG. 3 is an exploded view of the portable terminal and adapter of FIG. 1.
Figure 4:
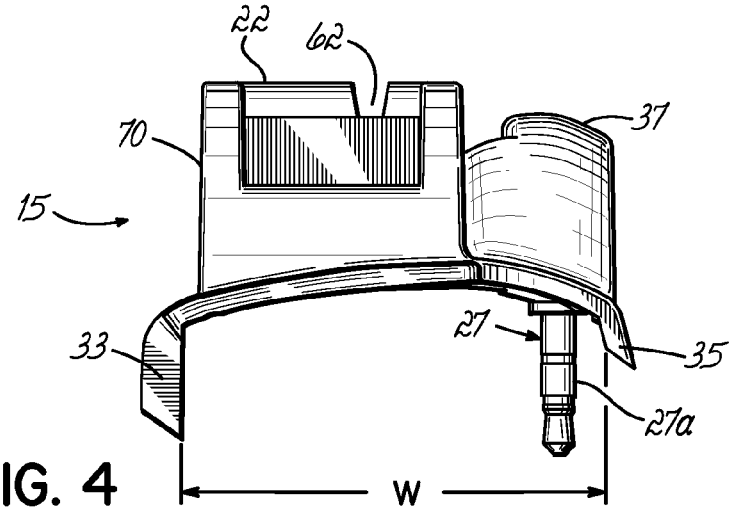
FIG. 4 is a bottom view of the adapter of FIG. 1 with the adapter removed from the portable terminal.
Figure 5:
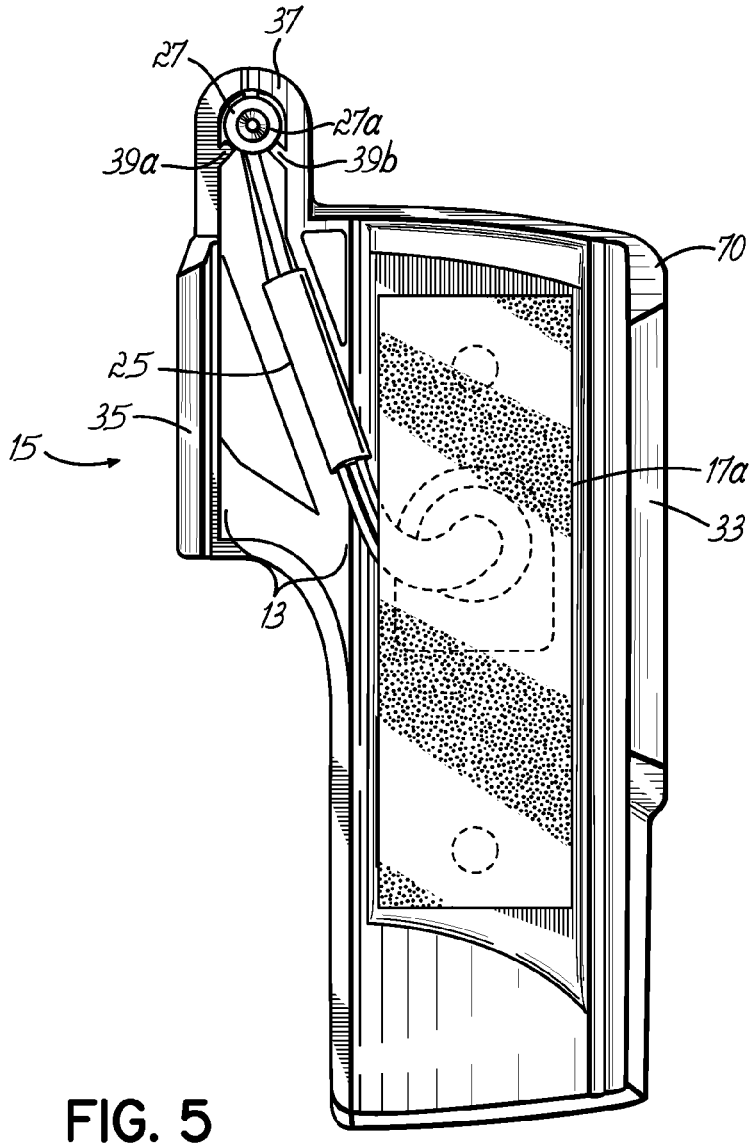
FIG. 5 is a rear view of the adapter of FIG. 1 with the adapter removed from the portable terminal.

With reference to FIG. 10 in which like reference numerals refer to like features in FIGS. 1-9 and in accordance with an alternative embodiment of the present invention, an adapter 100 includes the plug portion 20 and socket portion 22 that operate as described above. The adapter 100 is constructed to replace a portion (not shown) of the housing of a portable terminal 102. This housing portion is removed from the portable terminal 102 and replaced by the adapter 100. For example, the adapter 100 may be fastened to the portable terminal 102 with conventional fasteners (not shown) that are installed through clearance openings 104. The conductors 25 terminate with a connector 106 that interfaces the conductors 25 with a complementary connector 108 inside the terminal 102. In this manner, the peripheral device 12 may be coupled with the circuitry of the portable terminal 102.

The invention contemplates that other alternative approaches may be used to provide the terminal 10 with the capabilities of the break-away connector 16.

Figures 11, 12:
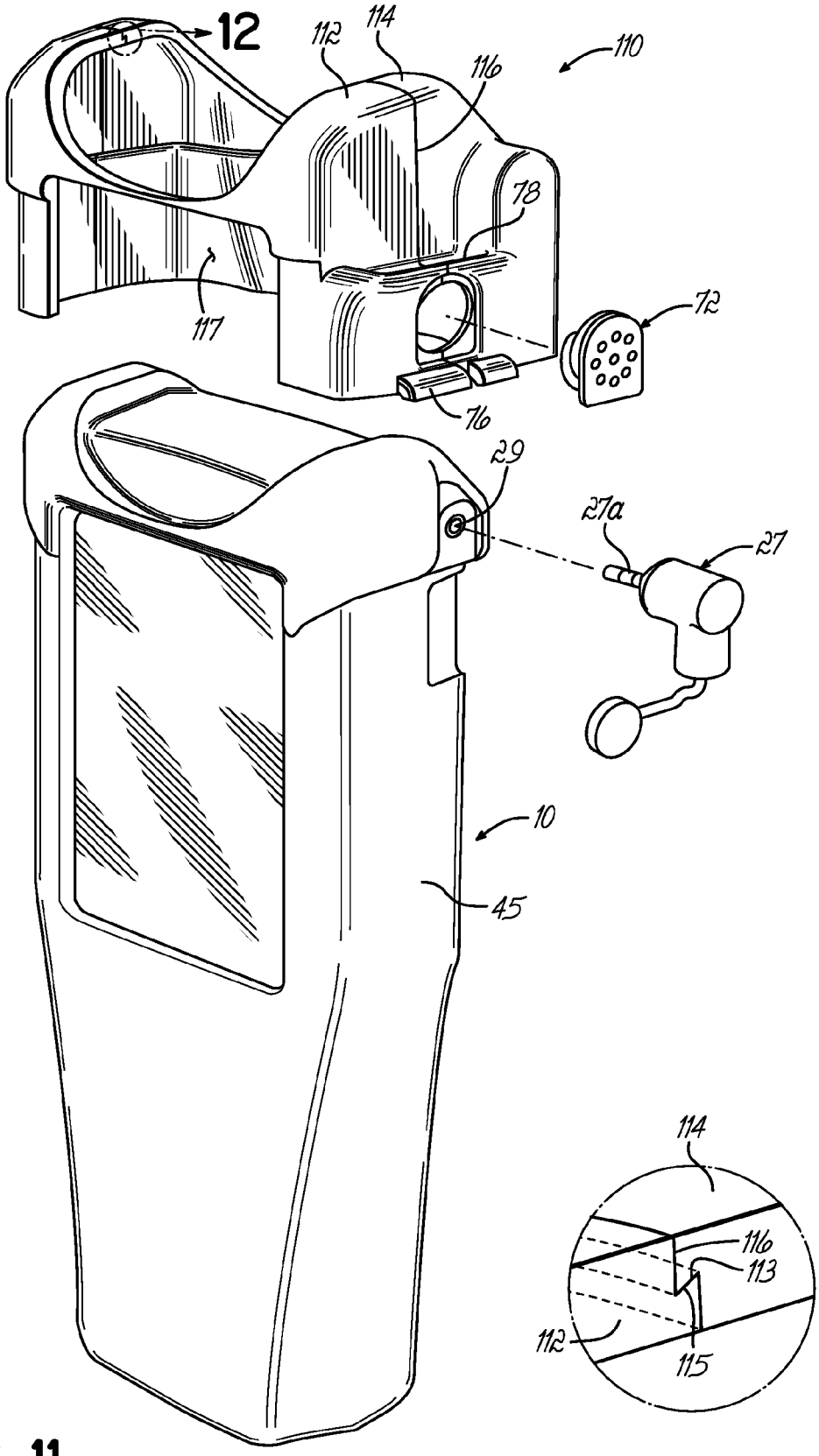
FIG. 11 is a partially disassembled isometric view showing an adapter in accordance with an alternative embodiment of the present invention and a terminal to which the adapter is mountable.
FIG. 12 is an enlarged detailed view of a circled portion of FIG. 11.
Figure 13:
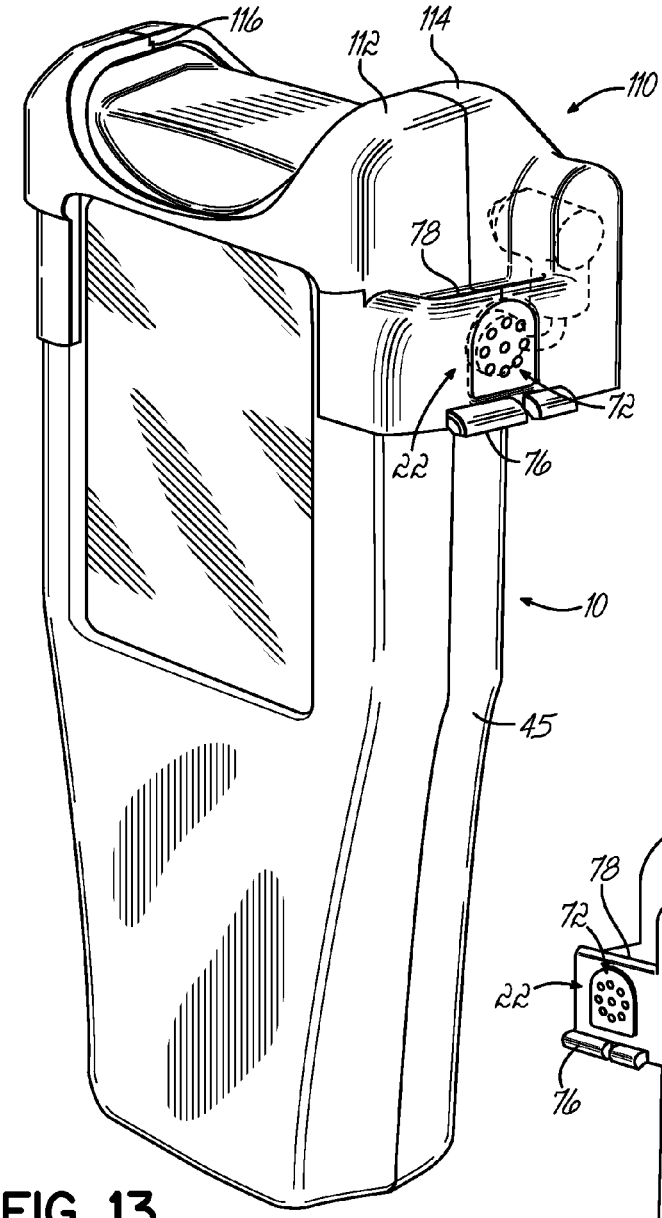
FIG. 13 is a front isometric view showing an adapter in accordance with an alternative embodiment of the present invention mounted to a terminal.

With reference to FIGS. 11-13 in which like reference numerals refer to like features in FIGS. 1-10 and in accordance with an alternative embodiment of the present invention, an adapter 110 may include a pair of shell members 112, 114 formed from a rigid plastic. The shell members 112, 114 couple together with a snap fit between cooperating inclined edges 113, 115, as best shown in FIG. 12, to form an assembly that carries the socket portion 22 and that also mates the tip 27*a* of electrical connector element 27 with the jack 29 of terminal 10.

Figure 14:
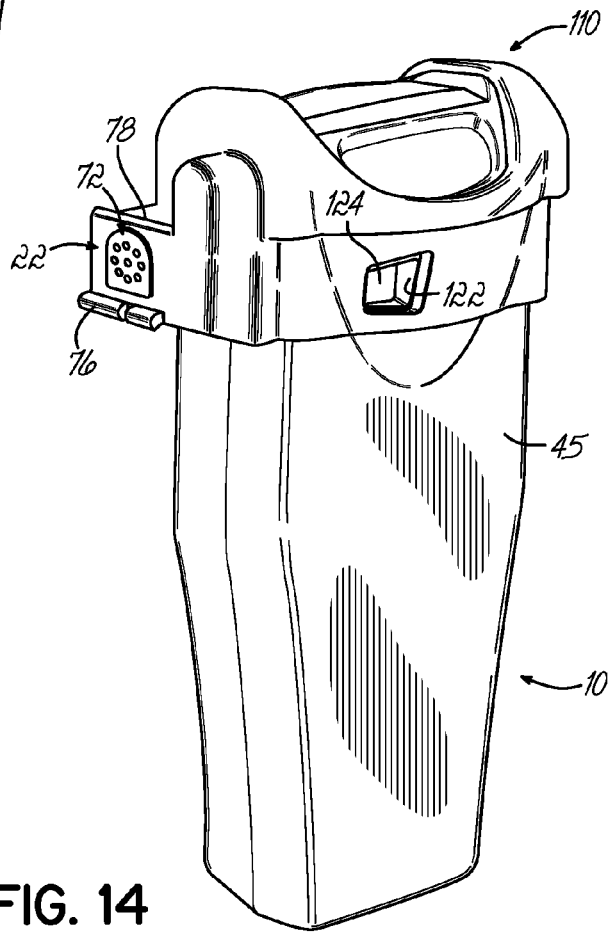
FIG. 14 is a rear isometric view of the adapter of FIG. 13.

The contour and dimensions of the interior surface 117 of the adapter 110 match the contour and dimensions of the outer case 45 of the terminal 10. The adapter 110 is easily removable from the terminal 10 by defeating the snap fit between inclined edges 113, 115 and separating the shell members 112, 114. In an alternative embodiment shown in FIG. 14, an adapter 120 similar to adapter 110 may have a seamless, unitary construction that lacks two separable members and, because of the seamless construction, include a window 122 that snap fits with a correspondingly-shaped projecting portion 124 of the outer case 45 to secure the adapter 120 to the terminal 10.

Figure 15:
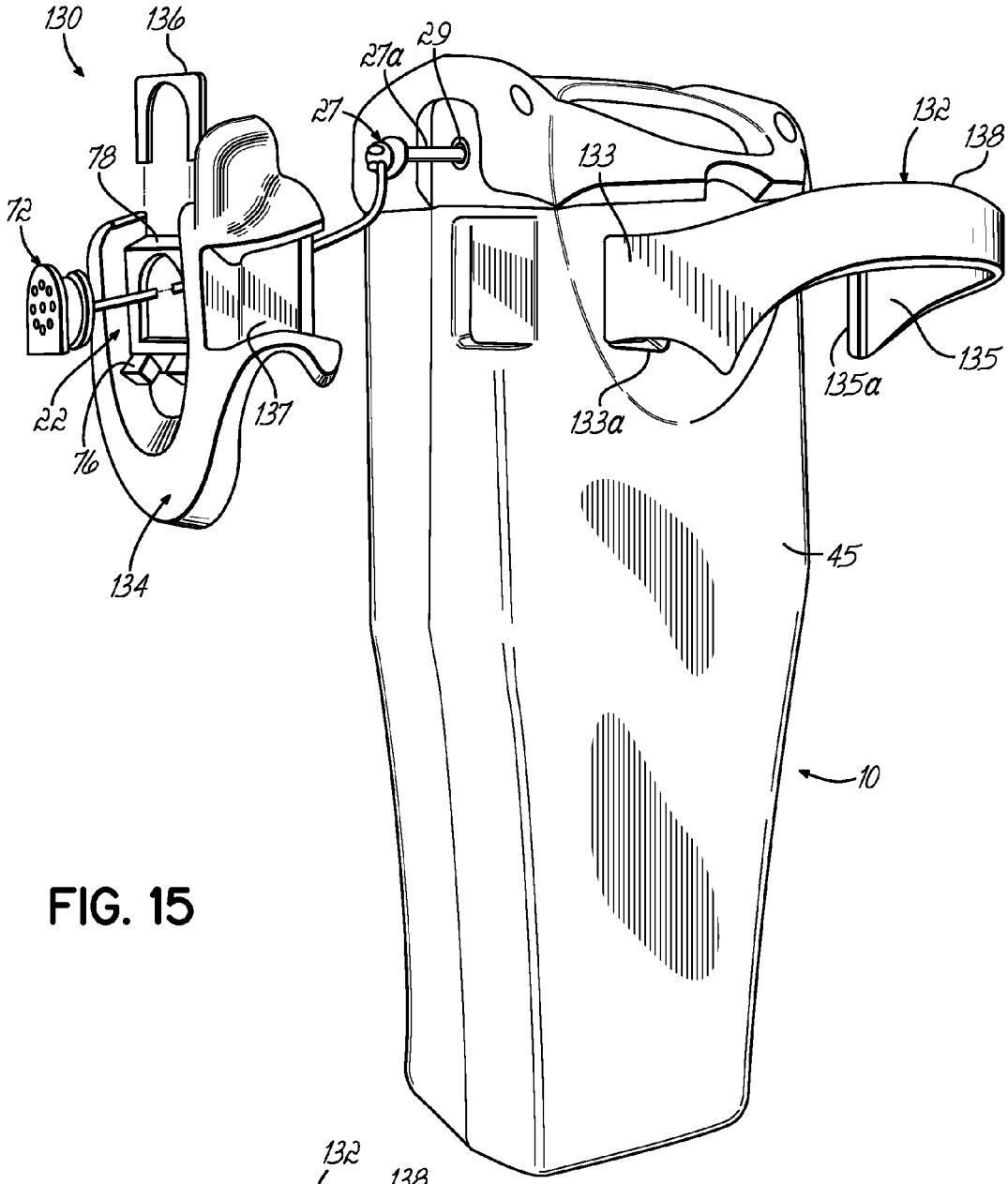
FIG. 15 is a partially disassembled isometric view showing an adapter in accordance with an alternative embodiment of the present invention and a terminal to which the adapted is mountable.
Figure 15A:
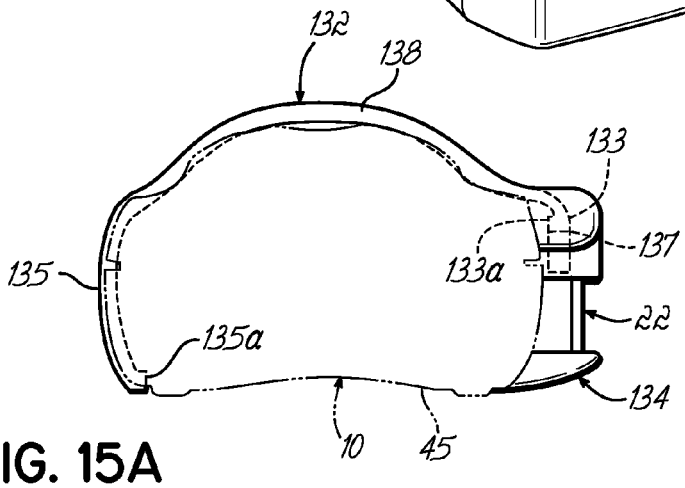
FIG. 15A is a top view of the assembly of FIG. 15.

With reference to FIGS. 15 and 15A in which like reference numerals refer to like features in FIGS. 1-14 and in accordance with an alternative embodiment of the present invention, an adapter 130 may include a fastening band or clip 132 formed from a polymer resin that grips opposite side edges of the outer case 45 for removably securing a housing 134 carrying the socket portion 22 to terminal 10. A connector 136 secures the fastening clip 132 with the housing 134 to form an assembly having the tip 27*a* of electrical connector element 27 mated with the jack 29 of terminal 10.

The arms 133, 135 of the fastening clip 132, which are connected by a central band 138, include corresponding lips 133*a*, 135*a* that cooperate with the resiliency of the arms 133, 135 to secure the clip 132 to the terminal 10. The lip 135*a* of arm 135 is disposed adjacent to and contacts a front face of the terminal 10. The lip 133*a* of arm 133 engages a contoured feature 137 of the housing 134. A portion of the housing 134 overlaps with the terminal 10 on the same front face of the terminal as lip 135*a*. In alternative embodiments of the invention, the clip 132 may comprise a wire formed type clip (not shown) or a stamped metal clip (not shown).

Figure 16:
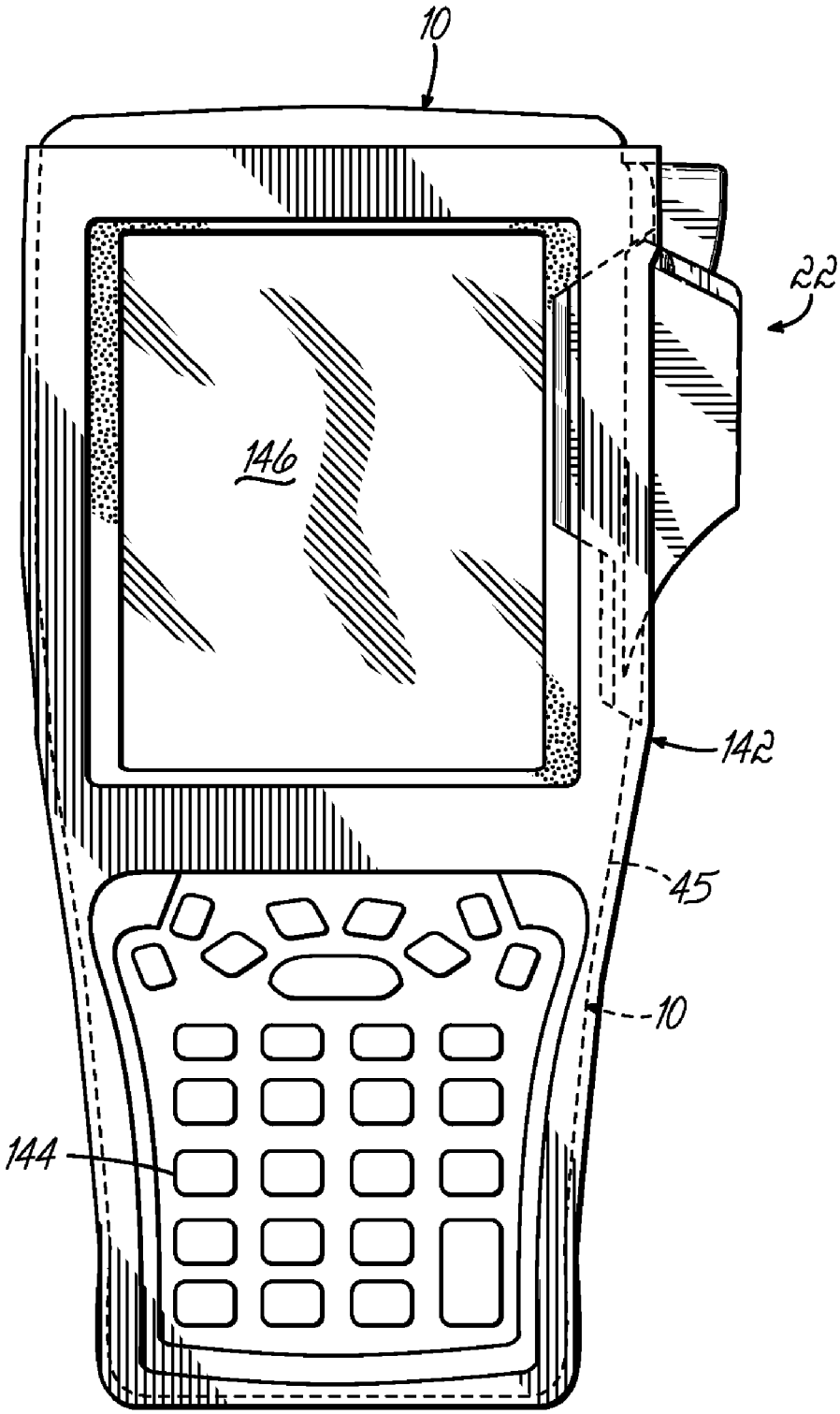
FIG. 16 is an isometric view showing an adapter in accordance with an alternative embodiment of the present invention mounted to a terminal.

With reference to FIG. 16 in which like reference numerals refer to like features in FIGS. 1-15 and in accordance with an alternative embodiment of the present invention, adapter 15, which carries the socket portion 22 of the break-away connector 16, may be secured to the outer case 45 of terminal 10 with a resilient tubular sleeve or boot 142. The boot 142 may be formed from a thin-walled sheet of a resilient material, such as an elastomer or silicone, so that the boot 142 compressively engages the terminal 10. The boot 142 is shaped with cutouts that permit access to functional elements of the terminal 10, such as a keypad 144 or a display 146. Alternatively, a protective skin integral with the boot 142 may fill the cutouts.

The boot 142 is configured to conform externally to the case 45 of the terminal 10 in a resilient manner. The boot 142 is dimensioned so that the boot 142 slips onto the outer case 45 and yet compressively grips the outer case 45 when placed on the terminal 10. The boot 142 participates in an assembly that mates the tip 27*a* of electrical connector element 27 with the jack 29 of terminal 10

While described herein with regard to a particular construction for the portable terminal 10, it will be appreciated that the adapters 15, 100 are applicable for use with other wearable, portable and mobile electronic devices connected by a wire or cord to a peripheral device. Moreover, while an exemplary embodiment is disclosed herein with respect to a voice headset, other peripherals 12 may also be utilized equally with the present invention. For example, bar code readers, scanners, printers and other peripherals, which might be coupled with portable terminal 10 through cord 14, will also benefit from the aspects of the present invention. Furthermore, while an exemplary embodiment is described with respect to use of the adapter 15 and portable terminal 10 in an inventory management environment, the principles of the invention will have equal applicability to other terminals or electronic devices, and other operating environments.

While the present invention has been illustrated by the description of the various embodiments thereof, and while the embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicants' general inventive concept.

What is claimed is:

1. An adaptor apparatus for connecting a cord of a peripheral device with a wearable, mobile and/or portable terminal, the terminal including electronics and an external case with an existing receptacle capable of receiving an electrical connector element, the adaptor apparatus comprising:

a housing defining a socket and including an engagement lip with an angled surface proximate the socket, the housing configured to be coupled with the external case of the terminal;

a plurality of first electrical contacts positioned at a mating surface of the socket;

an electrical connector element configured to be received by the existing receptacle of the terminal, the electrical connector element coupled to the plurality of first electrical contacts and establishing a functional path for electrical communications between the terminal and the mating surface of the socket; and a plug member for placement at the end of the cord of the peripheral device, the plug member including a plurality of second electrical contacts positioned at a mating surface of the plug and a pivoting lever arm with an engagement claw having an angled surface, the plug member configured to plug into the socket for electrically coupling the first and second electrical contacts, the lever arm biased with a biasing force to a first position in which the angled surface of the engagement claw engages the angled surface of the engagement lip for securing the plug in the socket, and the lever arm moveable to a second position in which the angled surface of the engagement claw is disengaged from the angled surface of the engagement lip for unplugging the plug member from the socket;

wherein the angled surface of the engagement claw moves relative to the angled surface of the engagement lip to pivot the lever arm from the first position toward the second position, without manual actuation, when a break-away force is transferred from the cord to the plug member effective to overcome the biasing force and unplug the plug member from the socket.

2. The apparatus of claim 1 further comprising:

a resilient boot configured to conform externally to the case of the terminal, wherein the housing is secured between the resilient boot and the case of the terminal.

3. The apparatus of claim 1 further comprising:

a clip configured to be secured with the case of the terminal, wherein the housing is secured to the clip.

4. The apparatus of claim 1 wherein the housing comprises a pair of shell members configured to be mutually secured about the case of the terminal.

5. The apparatus of claim 1 wherein the housing is affixed to the terminal as a replacement for a portion of the case of the terminal.

6. The apparatus of claim 1 wherein the electrical connector element is selected from the group consisting of an audio connector, a D-subminiature connector, a high-density connector, a universal serial bus mini-B connector, and an IEEE-1394 connector.

7. The apparatus of claim 1 wherein the electrical connector element is supported by the housing and is external to the case of the terminal.

8. The apparatus of claim 1 wherein the electrical connector element is internal to the case of the terminal.

9. The apparatus of claim 1 further comprising:

a mounting plate for affixing the housing to the case of the terminal.

10. The apparatus of claim 9 wherein the mounting plate is adapted to be adhesively bonded to the case of the terminal.

11. The apparatus of claim 9 wherein the housing includes a first skirt and a second skirt separated from the first skirt by a distance sufficient to insert a side edge of the case of the terminal between the first and second skirts.

12. The apparatus of claim 9 wherein the mounting plate is adapted to be mechanically attached to the case of the terminal.

13. The apparatus of claim 12 wherein the mounting plate further includes a plurality of internally-threaded posts, and the housing includes a plurality of clearance openings registered with the posts to provide engagement points for fastening the housing to the mounting plate with fasteners.

14. An adaptor apparatus for coupling with a wearable, mobile and/or portable terminal, the terminal having electronics and an external case with an existing electrical connector receptacle capable of receiving an electrical connector element, the adapter providing a damage resistant connection between an end of a cord of a peripheral device and the terminal, the adaptor apparatus comprising:

a housing defining a socket and including an engagement lip with an angled surface proximate the socket, the housing configured to be coupled with the external case of the terminal;

a plurality of first electrical contacts positioned at a mating surface of the socket:

an electrical connector element configured to be received by the existing receptacle of the terminal, the electrical connector element coupled to the plurality of first electrical contacts establishing a functional path for electrical communications between the terminal and the mating surface of the socket, the socket presented by the housing at the face of the terminal; and a plug member for placement at the end of the cord of the peripheral device, the plug member including a plurality of second electrical contacts positioned at a mating surface of the plug member and a pivoting lever biased with a biasing force to a first position for securing the plug in the socket, the plug member configured to plug into the socket for connecting the first and second electrical contacts, and the lever arm moveable from the first position to a second position for unplugging the plug member from the socket, without manual actuation, when a break-away force is transferred from the cord to the plug member effective to overcome the biasing force.

15. The apparatus of claim 14 further comprising:

a resilient boot configured to conform externally to the case of the terminal, wherein the housing is secured between the resilient boot and the case of the terminal.

16. The apparatus of claim 14 further comprising:

a clip configured to be secured to the case of the terminal, wherein the housing is secured to the clip.

17. The apparatus of claim 14 wherein the housing comprises a pair of shell members configured to be mutually secured about the case of the terminal.

18. The apparatus of claim 14 wherein the housing includes a first skirt and a second skirt separated from the first skirt by a distance sufficient to insert a side edge of the case of the terminal between the first and second skirts.

19. The apparatus of claim 14 wherein the housing is affixed to the terminal as a replacement for a portion of the case of the terminal.

20. The apparatus of claim 14 wherein the electrical connector element is selected from the group consisting of an audio connector, a D-subminiature connector, a high-density connector, a universal serial bus mini-B connector, and an IEEE-1394 connector.

21. The apparatus of claim 14 wherein the electrical connector element is supported by the housing and is external to the case of the terminal.

22. The apparatus of claim 14 wherein the electrical connector element is internal to the case of the terminal.

23. The apparatus of claim 14 further comprising:

a mounting plate for affixing the housing to the case of the terminal.

24. The apparatus of claim 23 wherein the mounting plate is adapted to be adhesively bonded to the case of the terminal.

25. The apparatus of claim 23 wherein the mounting plate is adapted to be mechanically attached to the case of the terminal.

26. The apparatus of claim 25 wherein the mounting plate further includes a plurality of internally-threaded posts, and the housing includes a plurality of clearance openings registered with the posts to provide engagement points for fastening the housing to the mounting plate with fasteners.

27. An apparatus for use with a wearable, mobile and/or portable terminal, the terminal including electronics and an external case with an existing receptacle capable of receiving an electrical connector element, the apparatus comprising:

a peripheral device having a cord with an end;

a housing defining a socket and including an engagement lip with an angled surface proximate the socket, the housing configured to be coupled to the external case of the terminal;

a plurality of first contacts positioned at a mating surface of the socket;

an electrical connector element configured to be received by the existing receptacle of the terminal, the electrical connector element coupled to the plurality of first electrical contacts and establishing a functional path for electrical communications between the terminal and the mating surface of the socket; and a plug member coupled with the end of the cord of the peripheral device, the plug member including a plurality of second electrical contacts positioned at a mating surface of the plug and a pivoting lever arm with an engagement claw having an angled surface, the plug member configured to plug into the socket for electrically coupling the first and second electrical contacts, the lever arm biased with a biasing force to a first position in which the angled surface of the engagement claw engages the angled surface of the engagement lip for securing the plug in the socket, and the lever arm moveable to a second position in which the angled surface of the engagement claw is disengaged from the angled surface of the engagement lip for unplugging the plug member from the socket;

wherein the angled surface of the engagement claw moves relative to the angled surface of the engagement lip to pivot the lever arm from the first position toward the second position, without manual actuation, when a break-away force is transferred from the cord to the plug member effective to overcome the biasing force and thereby unplug the plug member from the socket.

28. The apparatus of claim 27 wherein the peripheral device includes a headset electrically coupled with the cord.

29. The apparatus of claim 27 wherein the housing includes a first skirt and a second skirt separated from the first skirt by a distance sufficient to insert a side edge of the case of the terminal between the first and second skirts.

30. The apparatus of claim 27 further comprising:

a resilient boot configured to conform externally to the case of the terminal, wherein the housing is secured between the resilient boot and the case of the terminal.

31. The apparatus of claim 27 further comprising:

a clip configured to be secured to the case of the terminal, wherein the housing is secured to the clip.

32. The apparatus of claim 27 wherein the housing comprise a pair of shell members configured to be mutually secured about the case of the terminal.

33. The apparatus of claim 27 wherein the housing is affixed to the terminal as a replacement for a portion of the case of the terminal.

34. The apparatus of claim 27 wherein the electrical connector element is selected from the group consisting of an audio connector, a D-subminiature connector, a high-density connector, a universal serial bus mini-B connector, and an IEEE-1394 connector.

35. The apparatus of claim 27 wherein the electrical connector element is supported by the housing and is external to the case of the terminal.

36. The apparatus of claim 27 wherein the electrical connector element is internal to the case of the terminal.

37. The apparatus of claim 27 further comprising:

a mounting plate for affixing the housing to the case of the terminal.

38. The apparatus of claim 37 wherein the mounting plate is adapted to be adhesively bonded to the case of the terminal.

39. The apparatus of claim 37 wherein the mounting plate is adapted to be mechanically attached to the case of the terminal.

40. The apparatus of claim 39 wherein the mounting plate further includes a plurality of internally-threaded posts, and the housing includes a plurality of clearance openings registered with the posts to provide engagement points for fastening the housing to the mounting plate with fasteners.

* * * * *

UNITED STATES PATENT AND TRADEMARK OFFICE

CERTIFICATE OF CORRECTION

PATENT NO. : 7,442,060 B2
APPLICATION NO. : 11/461558
DATED : October 28, 2008
INVENTOR(S) : Henry J. Suwalski et al.

It is certified that error appears in the above-identified patent and that said Letters Patent is hereby corrected as shown below:

In column 1, line 8, after "specifically", delete ",".

In column 5, line 32, change "supports" to --support--.

In column 11, line 3, change "include" to --includes--.

In column 12:
Line 11, Claim 1, change "adaptor" to --adapter--.
Line 15, Claim 1, change "adaptor" to --adapter--.

In column 13:
Line 23, Claim 14, change "adaptor" to --adapter--.
Line 27, Claim 14, change "adaptor" to --adapter--.
Line 29, Claim 14, change "adaptor" to --adapter--.
Line 35, Claim 14, change ":" to --;--.

In column 15, line 15, Claim 32, change "comprise" to --comprises--.

Signed and Sealed this

Third Day of November, 2009

David J. Kappos

David J. Kappos
*Director of the United States Patent and Trademark Office*